US006547322B2

(12) United States Patent
Marx

(10) Patent No.: US 6,547,322 B2
(45) Date of Patent: Apr. 15, 2003

(54) COLLAPSIBLE RECLINING CHAIR

(76) Inventor: Edward Michael Marx, P.O. Box 9843, San Diego, CA (US) 92169

( * ) Notice: Subject to any disclaimer, the term of this patent is extended or adjusted under 35 U.S.C. 154(b) by 0 days.

(21) Appl. No.: 09/931,673

(22) Filed: Aug. 17, 2001

(65) Prior Publication Data

US 2003/0034675 A1 Feb. 20, 2003

(51) Int. Cl.[7] ..... A47C 4/28
(52) U.S. Cl. ..... 297/45; 297/40; 297/360
(58) Field of Search ..... 297/45, 44, 42, 297/40, 35, 360, 359, 16.2, 188.14

(56) References Cited

U.S. PATENT DOCUMENTS

| | | | | |
|---|---|---|---|---|
| 244,216 | A | | 7/1881 | Fenlay |
| 488,911 | A | * | 12/1892 | Weber |
| 514,403 | A | | 2/1894 | Allen |
| 2,691,410 | A | | 10/1954 | Boucher |
| 2,713,385 | A | * | 7/1955 | McQuilkin |
| 2,722,972 | A | | 11/1955 | Altruda |
| 3,124,387 | A | | 3/1964 | Maelaren |
| 3,136,272 | A | | 6/1964 | Sprigman |
| 3,635,520 | A | * | 1/1972 | Roher et al. |
| 4,014,591 | A | | 3/1977 | Gittings |
| 4,514,009 | A | | 4/1985 | Vanderminden |
| 5,335,967 | A | | 8/1994 | Vanderminden, Sr. |
| 5,570,928 | A | * | 11/1996 | Staunton et al. |
| 5,611,594 | A | * | 3/1997 | Findlay |
| 5,718,473 | A | * | 2/1998 | Lynch, Jr. |
| 5,882,068 | A | | 3/1999 | Levine |
| 5,893,605 | A | | 4/1999 | Chang |
| 5,984,406 | A | | 11/1999 | Lee |
| 6,135,557 | A | * | 10/2000 | Gustafsson |
| 6,149,238 | A | * | 11/2000 | Tsai |
| 6,179,374 | B1 | | 1/2001 | Tang |
| 6,264,271 | B1 | * | 7/2001 | Munn et al. |
| 6,270,156 | B1 | * | 8/2001 | Metzger et al. |
| 6,322,138 | B1 | * | 11/2001 | Tang |

* cited by examiner

*Primary Examiner*—Milton Nelson, Jr.

(57) ABSTRACT

A chair with four sets of leg tubes(22) consisting of two leg tubes(22) attached at their centers in an X position which fold into a collapsed position with leg tubes(22) nearly parallel to each other. Seat tubes(24), and back tubes(44) are pivotally attached to the upper ends of leg tubes(22) at the rear of the chair. Seat tubes(24) are connected to leg tubes (22) at the front of the chair by seat clips(30). This configuration of the chair in the open position, provides a stable structure for the attachment of a seat cover(42) and for the attachment of a mechanism for reclining back tubes(24) and back cover(11). Arm braces(18) extending from the top of leg tubes(22) at the rear of the chair, and connected to vertical tubes(14) extending from near the center of seat tubes(24) support arm tubes(8), which are attached to back tubes(44). Back tubes (44) recline by moving arm tubes(8) to different positions in slots in arm plates(12) attached near the front of arm tubes(8). Seat tubes(24) unclip from the front of the chair, and seat tubes(24), seat cover(42), back tubes(44), and back cover(11) pivot up and back to a position where seat tubes(24) and back tubes(44) are nearly parallel to leg tubes(22), forming a compact folded configuration.

8 Claims, 5 Drawing Sheets

COLLAPSIBLE RECLINING CHAIR

CROSS-REFERENCE TO RELATED APPLICATIONS

STATEMENT REGARDING FEDERALLY SPONSORED RESEARCH OR DEVELOPMENT

Not Applicable

REFERENCE TO A MICROFICHE INDEX

Not Applicable

BACKGROUND OF INVENTION

This invention is related to the field of folding chairs, especially chairs which can be collapsed into a compact position and easily transported.

Folding chairs have been designed with a rigid square back frame pivotally attached to the rear of a rigid square seat frame. These chairs typically have rigid u-shaped legs pivotally attached to the seat frame and arms. When the chair is folded the back frame folds parallel to the seat frame while the legs and arms fold parallel to the back frame. This configuration provides a chair with a rigid frame, which allows the seat material to be stretched taught between parallel frame members, and allows a mechanism which reclines the backrest of the chair to be located conveniently at the arm rests U.S. Pat. No. 5,144,03(Allen, 1894). The compactness of the chair in the folded position is, however, limited to the size of the rigid frame U.S. Pat. No. 4,514, 009(Vanderminden et al, 1985).

Another type of collapsible chair consist of four sets of two tubes pivotally attached at their centers in an X position. The four sets of tubes are pivotally attached perpendicular to each other at the ends of the bars U.S. Pat. No. 3,635,520 (Roher et al, 1972). This type of chair is folded by moving the legs of the chair toward one another until the legs are nearly parallel to each other. This forms a configuration in the collapsed position which is no longer limited to the size of a rigid frame. The size of this type of a collapsible chair in the folded position is only limited by the length of the back rest posts, which extend from the lower rear ends of the legs, through the upper rear leg hinges, to a position above the seat. This type of a collapsible design provides a chair that can be collapsed into a compact configuration, however, it does not incorporate some of the advantages provided by the chair with a rigid frame.

One of the disadvantages the collapsible chair has is that there is no longer a rigid frame to stretch the seat material between. Instead, the seat material is attached between the four upper corners of the legs and the weight of a seated person is used to force the legs to pivot out until the movement of the legs is restricted by the seat material. This design causes the seat to sag, because there is no rigid structure separating the leg bars. This design also causes the seat material to take more stress, since the seat material is fastened only at four concentrated points rather than being distributed along two rigid parallel members as it is with a chair with a rigid structure. Another disadvantage is that the mechanism for reclining the chair can not be located in a convenient location because there is no rigid structure on which to provide one. Instead, reclining mechanisms are located near the lower rear leg of the chair U.S. Pat. No. 6,179,374(Tang, 2001). To recline the chair the operator has to reach back to the lower portion of the legs near the back of the chair and unclip a mechanism to position the back rest bars, which pivot about the upper ends of the rear bars.

BRIEF SUMMARY OF THE INVENTION

Accordingly, several objects and advantages of my invention are as follows: the chair collapses into a bundle which is not limited by the width of a rigid frame structure nor by the length of a back member. The chair provides a rigid seat frame and a rigid backrest when clipped into the open position. A rigid structure allows the seat cover material and the backrest material to be stretched taught between members which results in a more comfortable seat, and reduces the required strength of the seat material. A rigid structure also allows the reclining mechanism to be conveniently located at the arm rests. Further objects and advantages of my invention will become apparent from consideration of the drawings and ensuing description.

REFERENCE NUMBERS IN DRAWING

Figure 1:
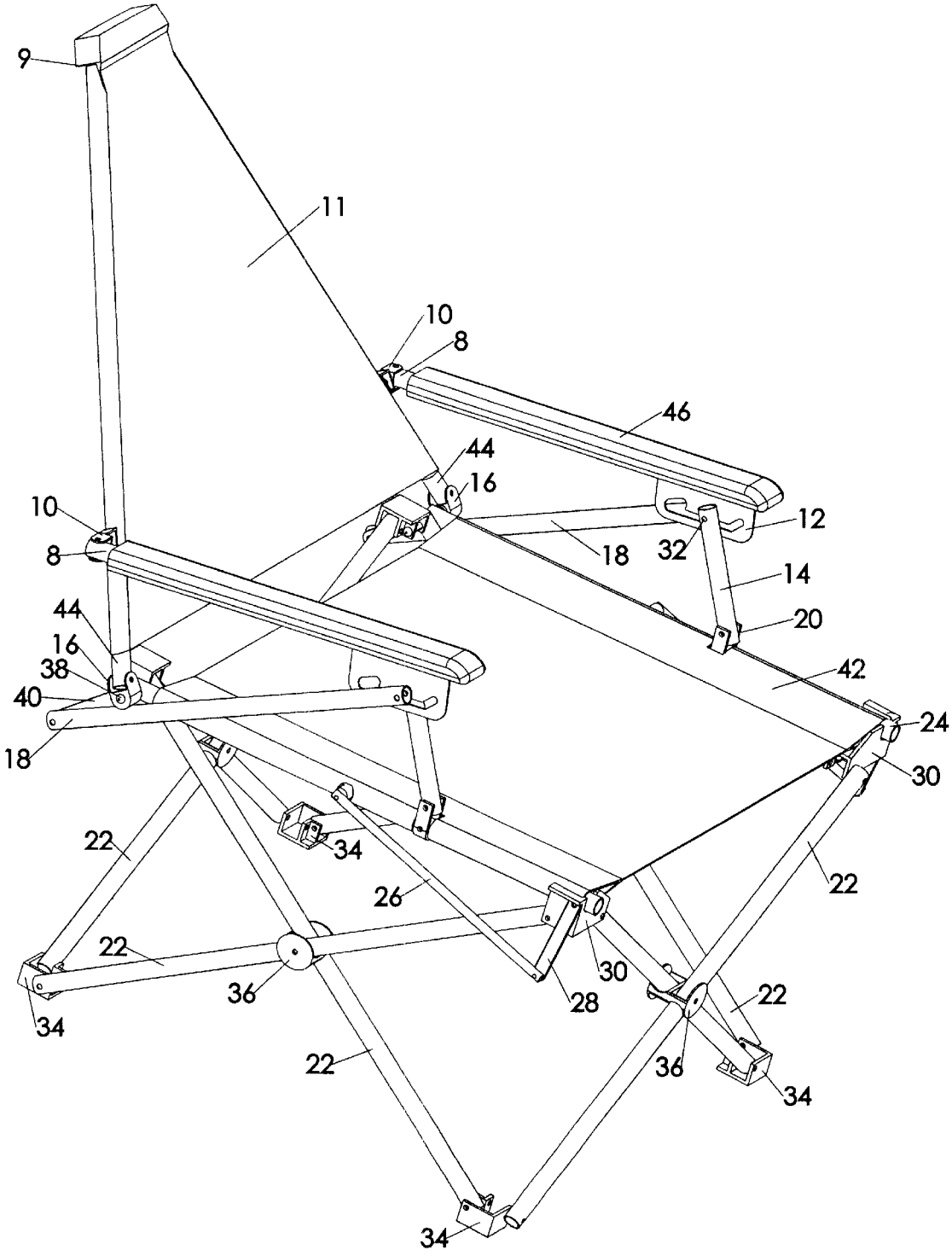
FIG. 1 shows a perspective view of the chair

8 arm tube
9 back cap
10 arm fastener
11 back cover
12 arm plate
14 vertical tube
16 back fastener
18 arm brace
20 vertical fastener
22 leg tube
24 seat tube
26 guide long
28 guide short
30 seat clip
32 plate bar
34 corner fastener
36 leg brace
38 rear pivot
40 rear lever
42 seat cover
44 back tube
46 arm cover

DESCRIPTION OF THE INVENTION

Figure 4A:
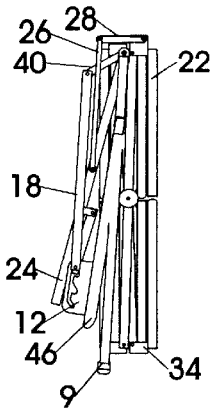
FIGS. 4A, B C, D E, F and G shows a sequence of the chair folding from the folded position to the open position and shows the chair in reclined positions

FIG. 1 shows a perspective view of a basic version of the chair. Leg tubes 22 are pivotally attached at their centers and held in an X position by leg braces 36. Leg tubes 22 are pivotally attached perpendicular to the ends of other legs tubes 22 at the lower ends and are pivotally attached at the rear upper ends by corner fasteners 34. The upper ends of two front leg tubes 22 are pivotally fastened perpendicular to two side leg tubes 22 by seat clips 30. Seat clips 30, corner fasteners 34, and leg braces 36 permit rotation of leg tubes 22 to a folded position where the leg tubes 22 are parallel to each other as shown in FIG. 4A.

Parallel seat tubes 24 pivot about a rear pivot 38 and fasten to the front of the chair by clipping into seat clips 30. Flexible material for a seat cover 42 is looped between seat tubes 22 allowing seat tubes 22 to rotate. Guides long 26 are pivotally attached at the center of seat tubes 24 and are pivotally attached to guides short 28 which are attached to seat clips 30. Guides help guide seat tubes 24 into seat clips 30, and guide the chair from the unfolded position to the folded position as shown in FIG. 4.

Figure 3:
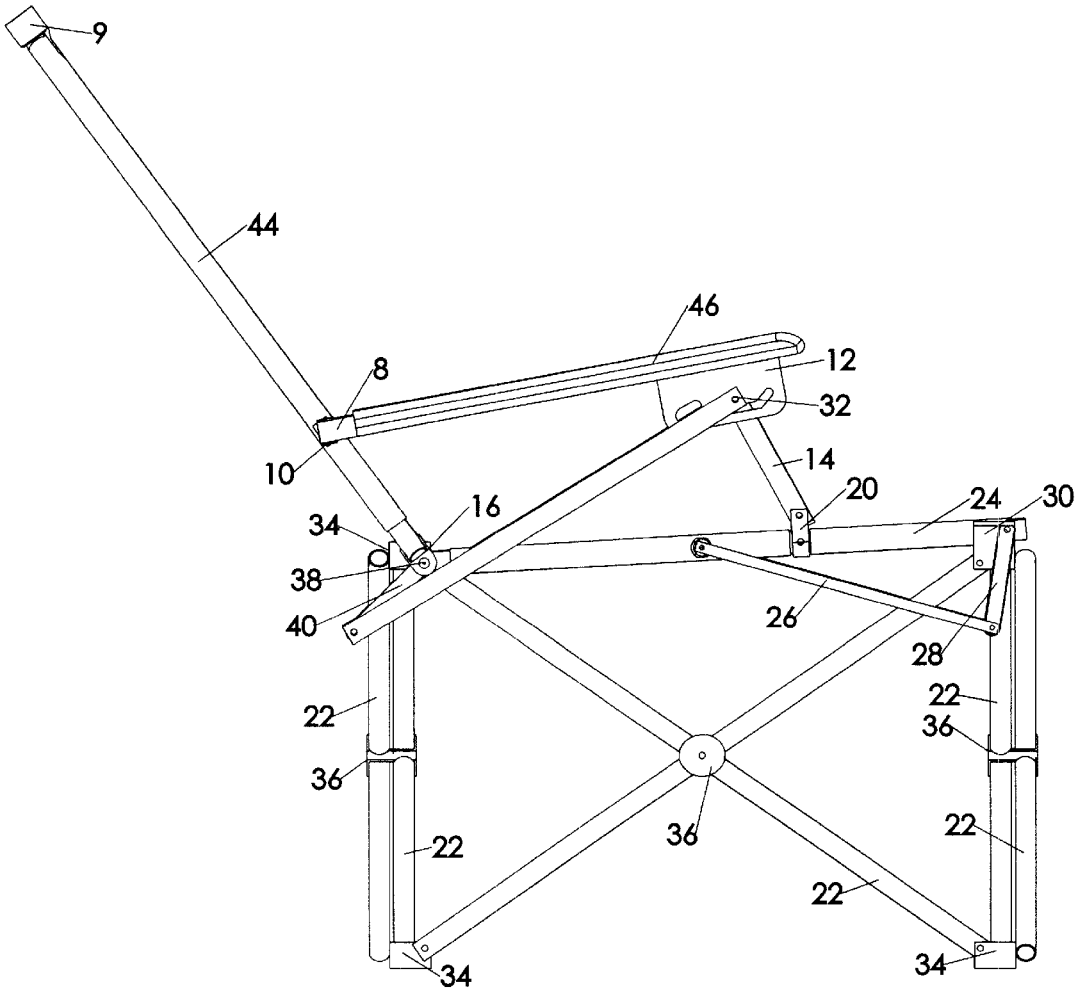
FIG. 3 shows a side view of the chair

A reclining mechanism of a chair can be seen in FIG. 3. A reclining mechanism consists of vertical tubes 14 pivotally attached to seat tubes 24 by vertical fasteners 20. vertical fasteners 20 permit vertical tubes 14 to pivot into a parallel position with the seat tubes 24. Arm braces 18 are pivotally attached to the top of vertical tubes 14 and are pivotally attached to rear levers 40. Rear levers 40 are pivotally attached to rear pivots 38. Rear levers 40 provide the distance necessary to allow arm braces 18 to move parallel to seat tubes 24. Arm tubes 8 are pivotally attached to back tubes 44 by arm fasteners 10 and arm covers 46 are attached to arm tubes 8 for comfort. Arm tubes 8 are attached to arm plates 12 which are slotted. Plate bars 32 are pivotally attached between the upper ends of vertical tubes 14 and the upper ends of arm braces 18. Plate bars 32 fit loosely in the slots of arm plates 12. Arm fasteners 10 permit the arm tubes 8 to pivot vertically as well as laterally to allow the back tubes 44 to fold parallel to the seat tubes 24.

A back rest of a chair can be seen in FIGS. 1 and 3. Back tubes 44 are pivotally attached to back fasteners 16 which are pivotally attached to rear pivots 38. Back fasteners 16 permit back tubes 44 to pivot about rear pivots 38 and to rotate laterally. The upper ends of back tubes 44 are pivotally attached to a back cap 9. The back cap 9 connection to back tubes 44 allows back tubes 44 to rotate permitting the chair to fold while restricting the top of the back tubes 44 from moving to the sides. Flexible material for a back cover 11 is stretched around the front of the back tubes 44 and fastened to the rear of the back tubes 44 as shown in FIGS. 1 and 3.

Operation of Invention

Figure 2:
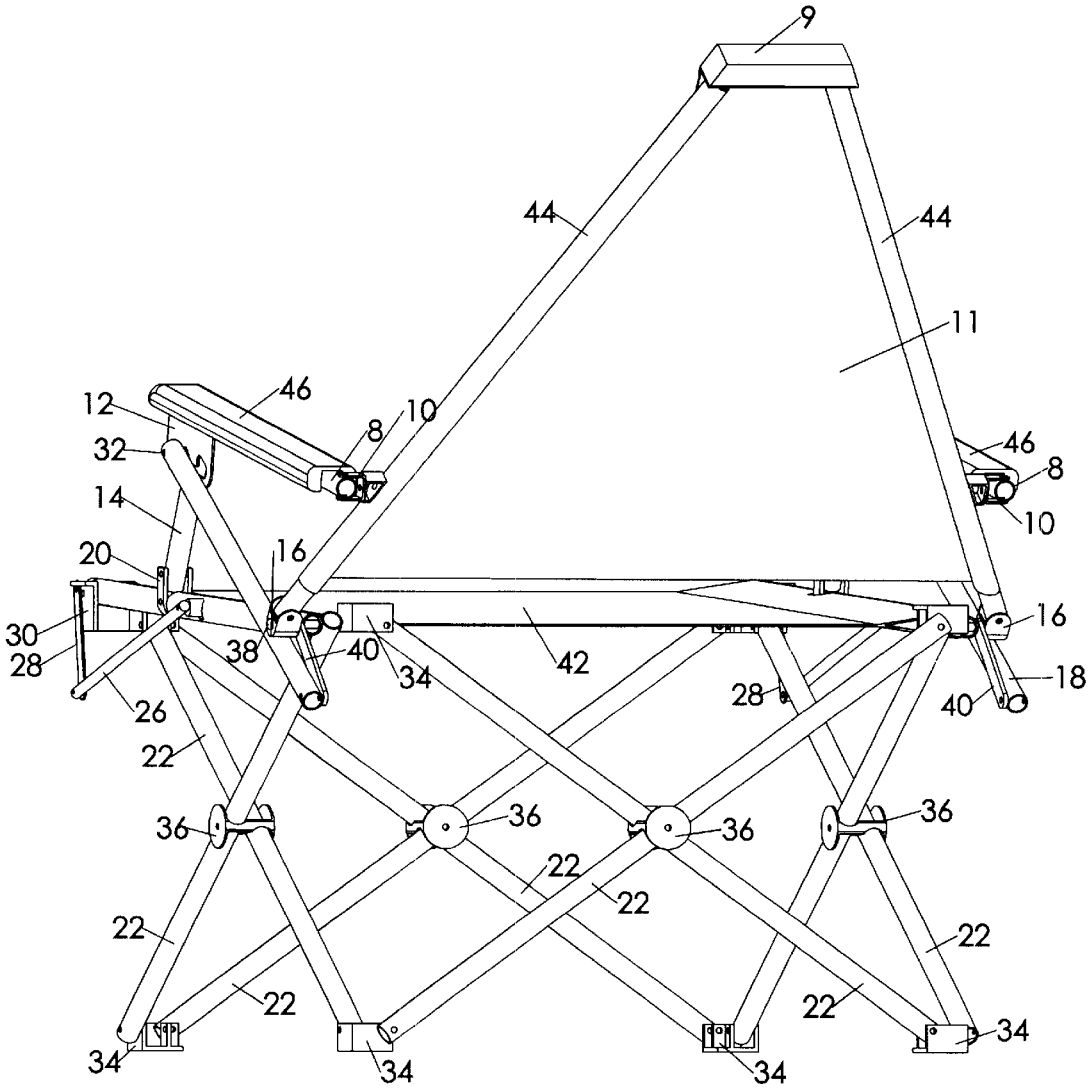
FIG. 2 shows a rear view of the chair
Figure 4B:
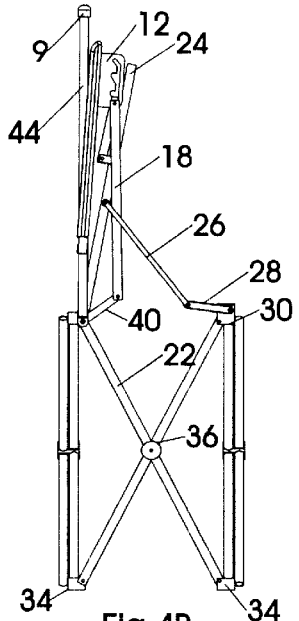
Figure 4C:
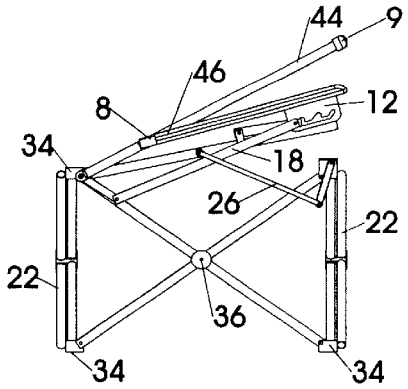
Figure 4D:
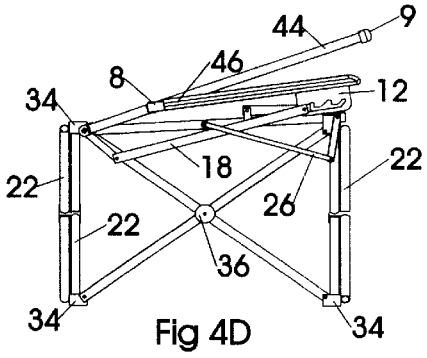
Figure 4E:
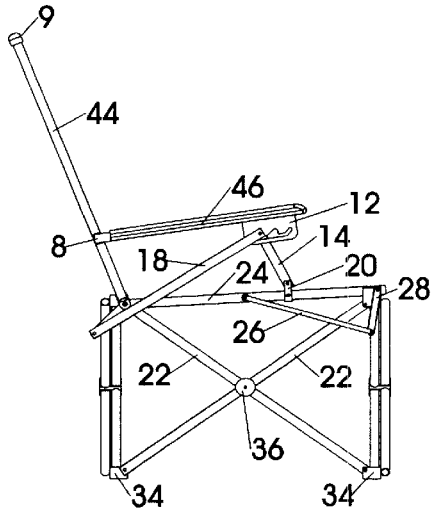
Figure 4F:
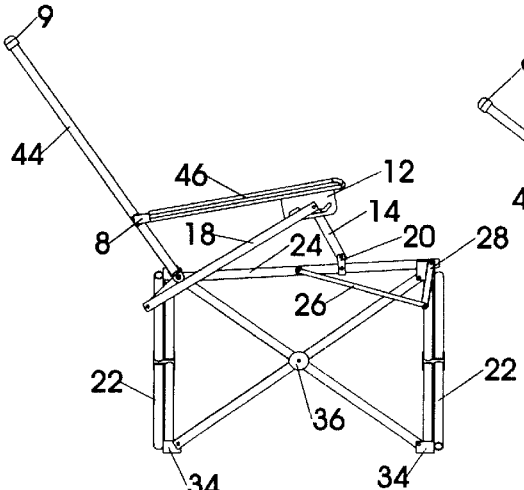
Figure 4G:
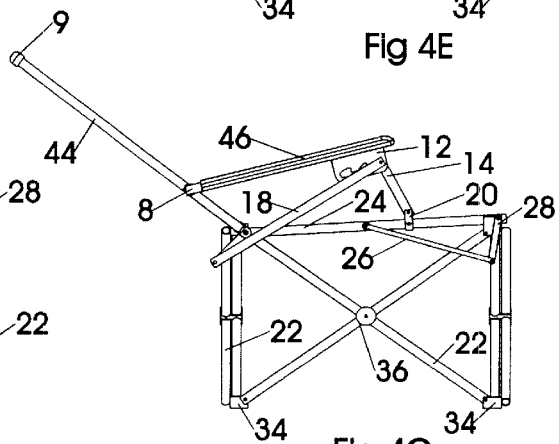
Figure 5:
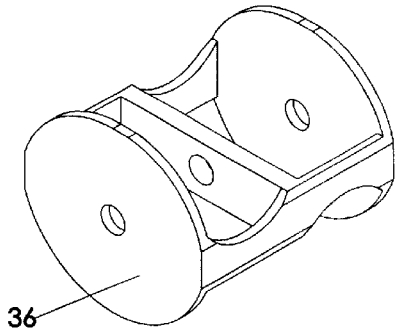
FIG. 5 shows a leg brace
Figure 6:
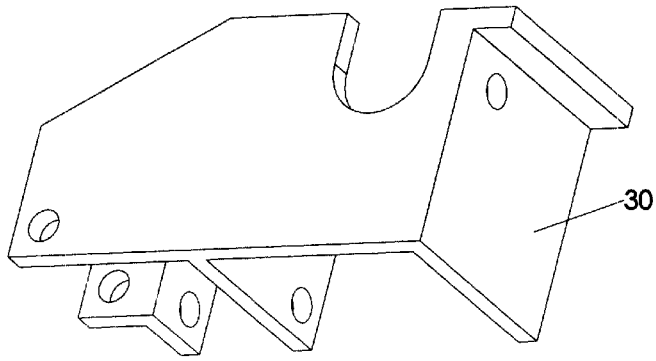
FIG. 6 shows a leg brace
Figure 7:
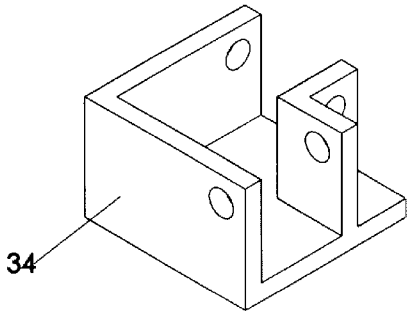
FIG. 7 shows a leg brace

As shown in FIGS. 4A, B, C, D, E, F, and G, the chair folds from a compact bundle, with leg tubes 22, back tubes 44, and seat tubes 24 nearly parallel to each other as shown in FIG. 4A, to a rigid frame structure having a reclining back rest as shown in FIGS. 4E, F, and G. The length of the chair in the folded position is determined by the length of leg tubes 22 or back tubes 44 depending on which is made longer, and the width of the chair in the folded position is determined by the thickness of the materials used For the chair to unfold, back tubes 44 and seat tubes 24 are pivoted about rear pivots 38 as shown in FIGS. 4B, C, and D. Leg tubes 22 separate in an X formation until they rest on leg braces 36 forming a stable base as shown in FIGS. 1 and 3. As the tops of seat tubes 24 and back tubes 44 reach the front of the chair as shown in FIG. 4D, seat tubes 24 are guided into seat clips 30 by guide short 28 and guide long 26, and are clipped into seat clips 30 as shown in FIG. 2. Tabs on seat clips 30, as shown in FIG. 6, assure guide long 26 and guide short 28 rotate down to the sides of the chair. This prevents guide short 28 and guide long 26 from rotating upward where they would rest in an awkward position near the front of the chair. Clipping seat tubes 24 into seat clips 30 holds seat tubes 24 apart, and stretches seat cover 42 taught between seat tubes 24 creating a comfortable seat. Seat cover 42 is attached to seat tubes 24 by wrapping the sides of seat cover 42 around seat tubes 24 and attaching seat cover 42 to itself as shown in FIGS. 1 and 3. This configuration, prevents seat tubes 24 from rotating as seat cover 42 rotates due to the deformation of seat cover 42 caused by the weight of a seated person.

With the chair in a configuration with seat tubes 24 clipped into seat clips 30 as shown in FIGS. 4D, E, F, and G a stable leg base is formed to attach a back cover 11. The lower ends of back tubes 44 are held apart by the configuration of leg tubes 22 as shown in FIG. 2. The upper ends of back tubes 44 are stabilized from moving to the sides by back cap 9. Back cap 9 also functions to separate the top ends of back tubes 44 providing the chair with a more comfortable back rest. Back cover 11 is wrapped around the front of back tubes 44 and attached to the rear of back tubes 44. This pulls back cover 11 flat at the front of back tubes 44, and forms a more comfortable back rest as can be seen in FIGS. 1 and 3.

FIGS. 4D, and E show how the chair reclining mechanism unfolds as the back tubes 44 are raised up and to the rear of the chair. Seat clips 30 hold seat tubes 24 in place, as back tubes 44 are rotated up and to the rear of the chair. As back tubes 44 are rotated up and to the rear, arm tubes 8 attached to back tubes 44 pull on vertical tubes 14 and arm braces 18 along with rear levers 40 rotating vertical tubes 14 upward and arm braces 18 back until arm braces 18 rest against rear pivots 38. In this position, as shown in FIG. 4E, seat tubes 24, arm braces 18, and vertical tubes 14 form a stable triangle where plate bar 32 connects arm braces 18 and vertical tubes 14. Arm tubes 8, which are connected to arm plates 12, are moved to different positions in slots in arm plates 12. This moves arm tubes 8 and arm plates 12 relative to plate bars 32, which rotates back tubes 44 about rear pivots 38 reclining the chair as shown in FIGS. 4E, F, and G.

Conclusions, Ramifications, and Scope of Invention

Thus the reader will see that the chair unfolds from a compact position smaller than previous designs to a stable structure with a comfortable seat and a backrest which conveniently reclines by a familiar mechanism located at the arm rests.

While my above description includes specific objects and functions of the current design, these should not be construed as limitations on the scope of the invention, but as an example of a design which can be created with a variety of modifications and alterations. Many other variations are possible. For example, guide long 26 and guide short 28 can be square or round bars, corner fasteners 34 can be construed as simple right angle brackets, or leg braces 36 can be constructed in a variety of shapes, sizes, or configurations. Accordingly, the scope of the invention should be determined not by the embodiment(s) illustrated, but by the appended claims and their legal equivalent.

What is claimed is:

1. A collapsible chair, comprising:

a pair of front crossed legs pivotally connected to each other and crossing each other at a point, each of said front crossed legs including a top end and an opposite bottom end;

a pair of rear crossed legs pivotally connected to each other and crossing each other at a point, each of said rear crossed legs including a top end and an opposite bottom end;

opposite pairs of side crossed legs separated by a distance and extending perpendicularly to the pair of front crossed legs and the pair of rear crossed legs, each pair of side crossed legs pivotally connected to each other and crossing each other at a point, each of said side crossed legs including a top end and an opposite bottom end, the top ends of the side crossed legs pivotally connected to the top ends of the front crossed legs and the rear crossed legs, the bottom ends of the side crossed legs pivotally connected to the bottom ends of the front crossed legs and the rear crossed legs;

a pair of opposite seat bars extending between the top ends of the respective pairs of side cross legs from the rear crossed legs to the front crossed legs, each seat bar including a rear end and an opposite front end, the rear ends of the seat bars pivotally connected to the top ends of the rear crossed legs and the front ends detachably fixed to the top ends of the front crossed legs;

a back rest pivotally connected to the top ends of the rear crossed legs;

a flexible material having a width no greater than the distance between the opposite side crossed legs and connected to the opposite seat bars along their length to form a firm seat collapsible inward to a dimension less than the distance between the opposite side crossed legs.

2. The collapsible chair of claim 1, further including arm rests connected to the back rest and the opposite side bars, the arm rests including a reclining mechanism to adjust the back rest to one of multiple reclined positions.

3. The collapsible chair of claim 1, wherein said back rest has a substantially triangular configuration.

4. The collapsible chair of claim 1, wherein the back rest includes a pair of seat tubes, each of said seat tubes including a top end and an opposite bottom end; the bottom ends of the seat tubes pivotally connected to the top ends of the rear crossed legs, and a back cap pivotally connected to the top ends of the seat tubes, the back rest having a width where the back cap connects the top ends of the seat tubes, and the backrest having a width where the bottom ends of the seat tubes are pivotally connected to the tops ends of the rear crossed legs that is greater than the width where the back cap connects the top ends of the seat tubes.

5. The collapsible chair of claim 1, further including a strap connected to the chair to retain the chair in a collapsed position.

6. The collapsible chair of claim 1, further including an alignment mechanism to align the front ends of the opposite seat bars with the top ends of the front crossed legs during attachment of the front ends of the opposite seat bars with the top ends of the front crossed legs.

7. The collapsible chair of claim 1, wherein the collapsible chair is collapsible to a collapsed longitudinally elongated configuration have a length and a maximum width, and the maximum width of the collapsed longitudinally elongated configuration is less than the distance between the opposite side crossed legs.

8. The collapsible chair of claim 1, further including arm rests connected to the back rest and the opposite side bars, the arm rests including cup holders.

* * * * *